United States Patent [19]

Pfau et al.

[11] Patent Number: 4,610,435

[45] Date of Patent: Sep. 9, 1986

[54] INDUSTRIAL FURNACE FOR THE THERMAL TREATMENT OF METAL WORKPIECES

[75] Inventors: Hans Pfau; Albert Fleiter, both of Kleve, Fed. Rep. of Germany

[73] Assignee: Ipsen Industries International GmbH, Kleve, Fed. Rep. of Germany

[21] Appl. No.: 684,358

[22] Filed: Dec. 21, 1984

[30] Foreign Application Priority Data

Dec. 23, 1983 [DE] Fed. Rep. of Germany ..... 3346884

[51] Int. Cl.[4] ..... C21D 9/00

[52] U.S. Cl. ..... 266/250; 266/259

[58] Field of Search ..... 266/249, 250, 259

[56] References Cited

U.S. PATENT DOCUMENTS

| | | | |
|---|---|---|---|
| 3,219,331 | 11/1965 | Ipsen | 266/250 |
| 3,565,410 | 2/1971 | Scheiff | 266/250 |

FOREIGN PATENT DOCUMENTS

| | | | |
|---|---|---|---|
| 2844843 | 4/1980 | Fed. Rep. of Germany . | |
| 155108 | 5/1982 | German Democratic Rep. | 266/250 |
| 1442517 | 7/1976 | United Kingdom | 266/250 |
| 2032082 | 4/1980 | United Kingdom . | |
| 2034447 | 6/1980 | United Kingdom . | |

OTHER PUBLICATIONS

Luiten et al., "The Vacuum Furnace and Its Use for Tool Steels" Metals and Materials Jul./Aug. 1976, pp. 31, 33, 35.

*Primary Examiner*—Christopher W. Brody

*Attorney, Agent, or Firm*—Becker & Becker, Inc.

[57] ABSTRACT

An industrial furnace, especially a single chamber vacuum furnace, for thermally treating metal workpieces. The furnace has a heating chamber which is disposed in a furnace housing and receives a charge. The heating chamber can be heated via heating elements, and has at least one closable chamber opening through which is conveyed a cooling gas which can be circulated with the aid of a blower through a heat exchanger. To control the flow of cooling gas arriving through the cooling gas delivery pipe, a distribution device which is moved back and forth during a cooling process is pivotably mounted in the region of the chamber opening which is provided for the entry of the cooling gas. In order to make it possible for the cooling gas to flow uniformly over the surface of the charge, jet nozzles are provided as the distribution means. The cooling gas flows through these jet nozzles prior to striking the charge.

13 Claims, 11 Drawing Figures

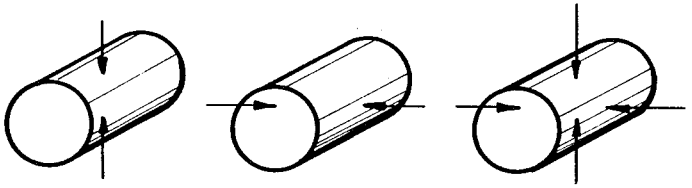
Fig.5a
Fig.5b
Fig.5c
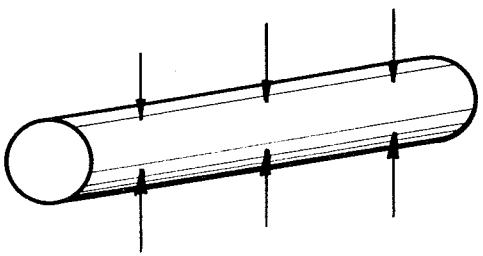
Fig.5d
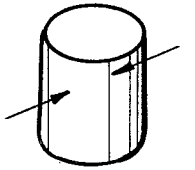
Fig.5e
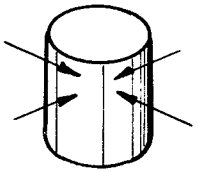
Fig.5f
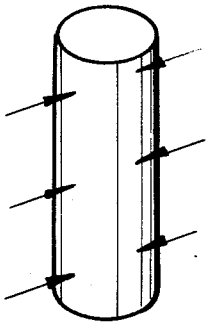
Fig.5g

INDUSTRIAL FURNACE FOR THE THERMAL TREATMENT OF METAL WORKPIECES

BACKGROUND OF THE INVENTION

1. Field of the Invention

The present invention relates to an industrial furnace, especially a single chamber vacuum furnace, for heat treating metal workpieces. The furnace has a heating chamber which is disposed in a furnace housing, and receives a charge; the heating chamber can be heated via heating elements, and is provided with at least one closable chamber opening through which there can be passed a cooling gas which, with the aid of a blower, can be circulated through a heat exchanger. To control the flow of cooling gas arriving through the cooling gas delivery pipe, a distribution means which can be moved back and forth during the cooling process is pivotably mounted in the region of the chamber opening provided for the entry of the cooling gas.

2. Description of the Prior Art

Industrial furnaces of this general type are used, in particular, in order to be able to harden pieces of high-speed steel tool and other tool steel. However, such furnaces are also suitable for other thermal treatments, such as for bright annealing. A furnace of this type comprises a double-walled steel housing having a front door which can be opened, thus permitting access to the heating chamber. The heating chamber comprises a steel casing which is lined with heat insulating material. The top and the bottom of the heating chamber are provided in a customary manner with a large opening for the passage of gas. During the heating and pretension cycles, these openings are closed-off by insulated blocking cover plates. The upper opening of the heating chamber for the passage of gas is connected directly via a pipe connection to the delivery pipe of a blower.

The gas stream which enters the heating chamber through the pipe connection is only in a position to flow over a relatively small charge. The charge cannot be enlarged because this would result in a reduction of the cooling rate. An approach is also not possible to enlarge the diameter of the pipe connection of the blower, because unless the capacity of the blower is changed, a loss in velocity of the cooling air would result. However, a high velocity of the cooling gas is necessary in order to achieve a rapid cooling of the charge. Accordingly, for example, there is only possible to carry out a hardening if the dissipation of heat is rapid enough. Thus, in order to achieve a rapid cooling of the charge, there is necessary to circulate the cooling gas which is blown into the heating chamber at a high velocity. At a given blower capacity, the velocity of the gas is a function of the diameter of the pipe connection; the pipe diameter, in turn, determines the size of the charge surface over which the cooling gas is to flow. Thus, in practice, the furnace output is inherently limited to a fixed grade of workpieces which are to be thermally treated.

Therefore, in order to increase the furnace output, and to better utilize the existing furnace capacity for subjecting a larger charge surface to a rapid cooling-off, German Offenlegungsschrift No. 28 44 8430 made a proposal to pivotably mount a flap or damper on the chamber opening provided for the entry of gas; this flap was intended to control the arriving flow of gas in the region of the open cross-section of the chamber opening. Such a flap only provided for a very imperfect circulation of the gas over the entire charge. Above all, the cooling gas does not flow uniformly over the surface of the charge, so that a nonuniform cooling-off results. This results in the danger of warping.

An object of the present invention, with an industrial furnace of the aforementioned general type, is to improve the pivotable distribution means in such a way that there is possible therewith for the cooling gas to flow uniformly over the surface of the charge.

BRIEF DESCRIPTION OF THE DRAWINGS

This object, and other objects and advantages of the present invention, will appear more clearly from the following specification in conjunction with a preferred embodiment which is schematically illustrated in the drawings, in which:

FIGS. 5*a*–5*g* are schematic arrangements of jet nozzle systems for various furnace constructions.

SUMMARY OF THE INVENTION

Figure 1:
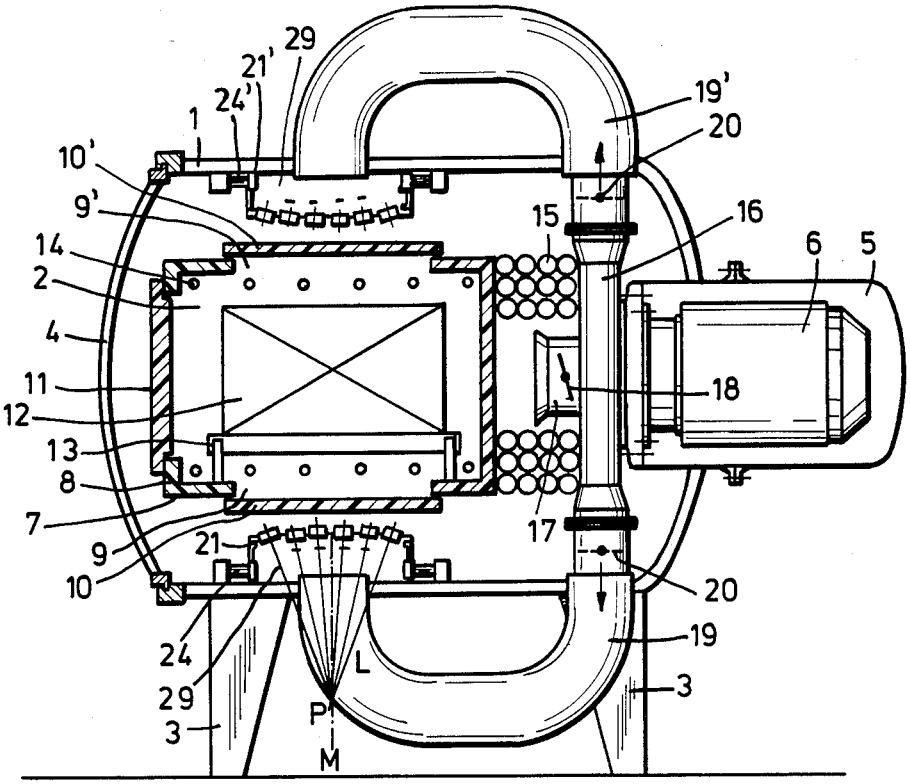
FIG. 1 is a longitudinal section through a single chamber vacuum furnace which has a pressurized gas quenching device.
Figure 2:
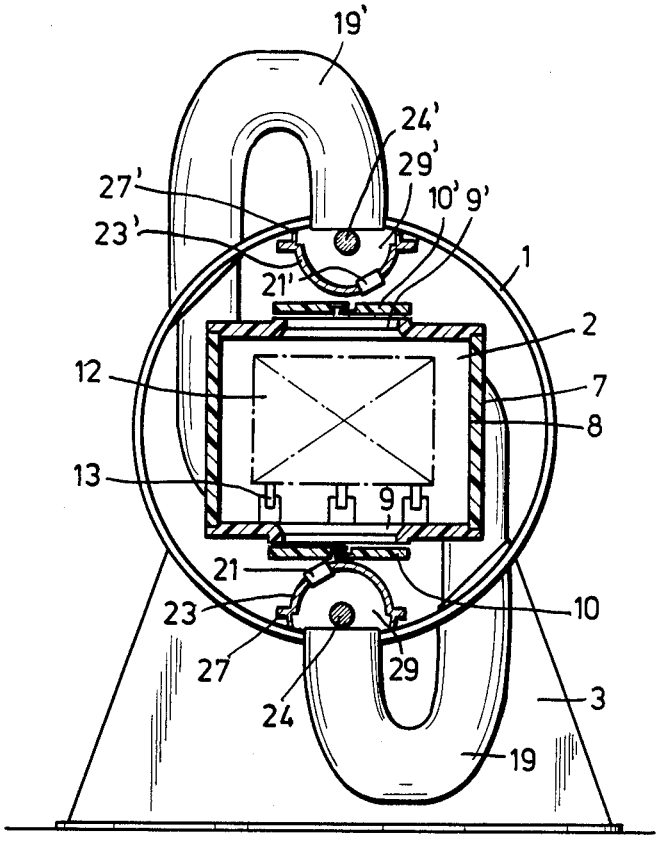
FIG. 2 is a corss-sectional view through the furnace of FIG. 1.

The furnace of the present invention is characterized primarily in that jet nozzles are provided as the distribution means, with the cooling gas flowing through the jet nozzles prior to striking the charge.

Via the inventive jet nozzles, there is possible to convey the cooling gas in a precise manner onto the surface of the charge, so that the latter can be cooled off uniformly. Thus, the danger of the cooling gas flowing nonuniformly over the surface of the charge is eliminated. The form and arrangement of the nozzles can be optimally adapted to the conditions encountered, whereby well-defined conditions can be obtained in the cooling process.

The jet nozzles are advantageously disposed directly ahead of the chamber opening. These jet nozzles are consequently disposed in the cold portion of the furnace. During cooling, they are cooled by the cooling gas which flows in the jet nozzle system at high speed, so that when the blocking cover plates which close-off the chamber opening are opened, the jet nozzles are only slightly heated up by the heat radiated by the charge onto the jet nozzle system. Therefore, the jet nozzles do not have to be made of special, heat-resistant alloys. Heat losses are completely eliminated with this inventive arrangement.

The jet nozzles are preferably cylindrical, and have the same diameter.

Pursuant to a further feature of the present invention, the pivot axis of the jet nozzles extends parallel and in a central cross-sectional plane of the chamber opening, with the jet nozzles being disposed parallel to the pivot axis in at least one row and symmetrical to the median perpendicular of the cross-sectional plane of the chamber opening, thus improving the directional effect of the jet nozzles. A further optimization is achieved if the longitudinal central axes of the jet nozzles meet in a point upstream on the median perpendicular of the cross-sectional plane of the chamber opening. This assures that the cooling gas flows uniformly onto the charge along the pivot direction of the jet nozzles.

To distribute the flow of cooling gas at the individual jet nozzles, each jet nozzle is provided, pursuant to a further feature of the present invention, with a throttle device. This device, and the angular arrangement of the jet nozzles, results in a uniform discharge velocity of the gas jets, and in a uniform impact velocity on the charge. This assures a uniform cooling of the charge transverse to the pivot direction.

In a preferred embodiment, the jet nozzles are disposed in the shell of a partial cylinder, the axis of which corresponds to the pivot axis; during pivoting, the outer or inner shell surface rests in a sealing manner against a sealing member which is disposed parallel to the partial cylinder, with the sealing member similarly being sealingly disposed on the end of the cooling gas delivery pipe which opens into the furnace housing. This represents a simple structural arrangement of the jet nozzles, which nonetheless operate reliably.

Since during a pivot movement the jet nozzles blow against the middle of the charge two times, which could lead to a more rapid cooling of the middle of the charge, the rate at which the jet nozzles pivot in the region of the extremes positions is preferably reduced.

Pursuant to a further feature of the present invention, the diameter of the jet nozzles is at least one tenth of the distance between the jet nozzles and the point at which the cooling gas impacts a charge. This takes into account the fact that the velocity of a gas flow which exits a jet nozzle decreases as the distance from the mouth of the jet nozzle increases. The velocity in the core of the stream remains nearly constant up to a distance of about ten times the diameter of the jet nozzle. For this reason, jet nozzle having a relatively large diameter are provided, so that the stream strikes the charge at nearly the same velocity at which it exits the jet nozzle.

Pursuant to a preferred embodiment of the present invention, there is proposed that opposite sides, especially the top and the bottom, of the heating chamber be provided with identical chamber openings and jet nozzles for delivering cooling gas into the heating chamber. The charge is thus acted upon from two sides by the cooling gas, thus accelerating the cooling process and making it even more uniform.

There is advantageous if the cooling gas delivery pipes for the jet nozzles are provided with throttle valves which regulate the flow-through indepedently of one another. This is effected with a view to the fact that the charge rests on support which must also be cooled off, and in particular additionally by the bottom jet nozzles. Therefore, a larger quantity of heat must be dissipated at the bottom than at the top, which is possible by throttling the cooling flows by means of the throttle valves in the cooling gas pipe at the top and at the bottom. There is thus possible to adapt the heat transfer independently of the geometry and the mass distribution, and doing so assures a uniform, nonwarping cooling of the parts.

Finally, if cooling is too rapid, a flow volume regulator can be disposed in front of the blower to regulate the cooling velocity of the cooling gas delivered to the jet nozzles, and to adapt this velocity to the conditions encountered.

DESCRIPTION OF PREFERRED EMBODIMENTS

Referring now to the drawings in detail, the single chamber vacuum furnace, which has a pressurized gas quenching or cooling device, essentially comprises a double-walled furnace housing 1 of steel; a heating chamber 2 is disposed in the housing 1. The furnace housing 1 is cylindrical, and rests on supports 3 which are welded to the bottom of the housing 1. One end of the furnace housing 1, in the drawing, the left end, is provided with a front door 4 which can be swung away, and which is also double-walled. The opposite end of the furnace housing 1, in the drawing, the right end, is provided with a centrally disposed, circular opening in which there is disposed a hood 5 for receiving a motor 6, which will be further described subsequently.

The heating chamber 2 comprises a steel casing 7 which is lined with a self-supporting graphite insulation 8. The heating chamber 2 is provided with a respective large opening 9 and 9' both at the bottom and at the top; the cooling gas can pass through these chamber openings 9, 9', which are closed-off during the heating and retension cycles by insulated blocking cover plates 10 and 10'. The opening and closing movements are effected pneumatically by means of non-illustrated piston/cylinder units. The heating chamber 2 can be supported on non-illustrated wheels, so that it can be pulled out of the furnace housing 1 in order to facilitate maintenance operations.

The front of the heating chamber 2 is closed off by an insulated door 11 which can be swung away, and through which a charge 12 in the form of a charge basket can be introduced into the chamber 2. For treatment, the charge 12 rests on a charge support 13. To permit observation of the interior of the heating chamber 2, a non-illustrated sight glass can be provided in the door 11.

Disposed within the heating chamber 2 above and below the charge 12 there are electrical heating elements 14 which assure a rapid heating of the charge 12 to the treatment temperature, and also assure considerable uniformity of the temperature. The supply of power to the heating elements 14 through the furnace housing 1 and the casing of the heating chamber 2 is of conventional design and need not be described in detail at this point.

A heat exchanger 15 having a plurality of cooling coils is disposed within the furnace housing 1 behind the heating chamber 2. Water is supplied to the heating coils via non-illustrated feed lines, and water is withdrawn from the cooling coils via discharge lines which are again not illustrated. The heat exchanger 15 serves to rapidly cool the cooling gas heated by the hot workpieces in the charge 12.

The cooling gas is circulated by a high-capacity blower 16 which is disposed coaxially with and behind the heat exchanger 15 within the furnace housing 1. The blower 16 has a central gas intake 17 on that side thereof which faces the heat exchanger 15. A flow volume regulator 18 is disposed in the gas intake 17 for adapting the cooling velocity to the existing conditions. The blower 16 is driven by the motor 6, which is coaxially accommodated within the hood 5, which enlarges the back end of the furnace housing 1.

Upper and lower pipes 19 and 19' for delivering cooling gas are connected to the blower 16; these pipes 19, 19' open into the top and bottom of the furnace housing 1. Each of the pipes 19, 19' for delivering cooling gas is provided with a respective throttle valve 20, 20' which can be actuated independently of one another, and with which the flow of the cooling gas through the pipes 19, 19', and hence the supply of the cooling gas from above and from below to the charge 12, can be regulated. As a result, nonuniformly shaped charges 12 can be uniformly cooled, since a greater quantity of heat can be dissipated from a given side.

Figure 3:
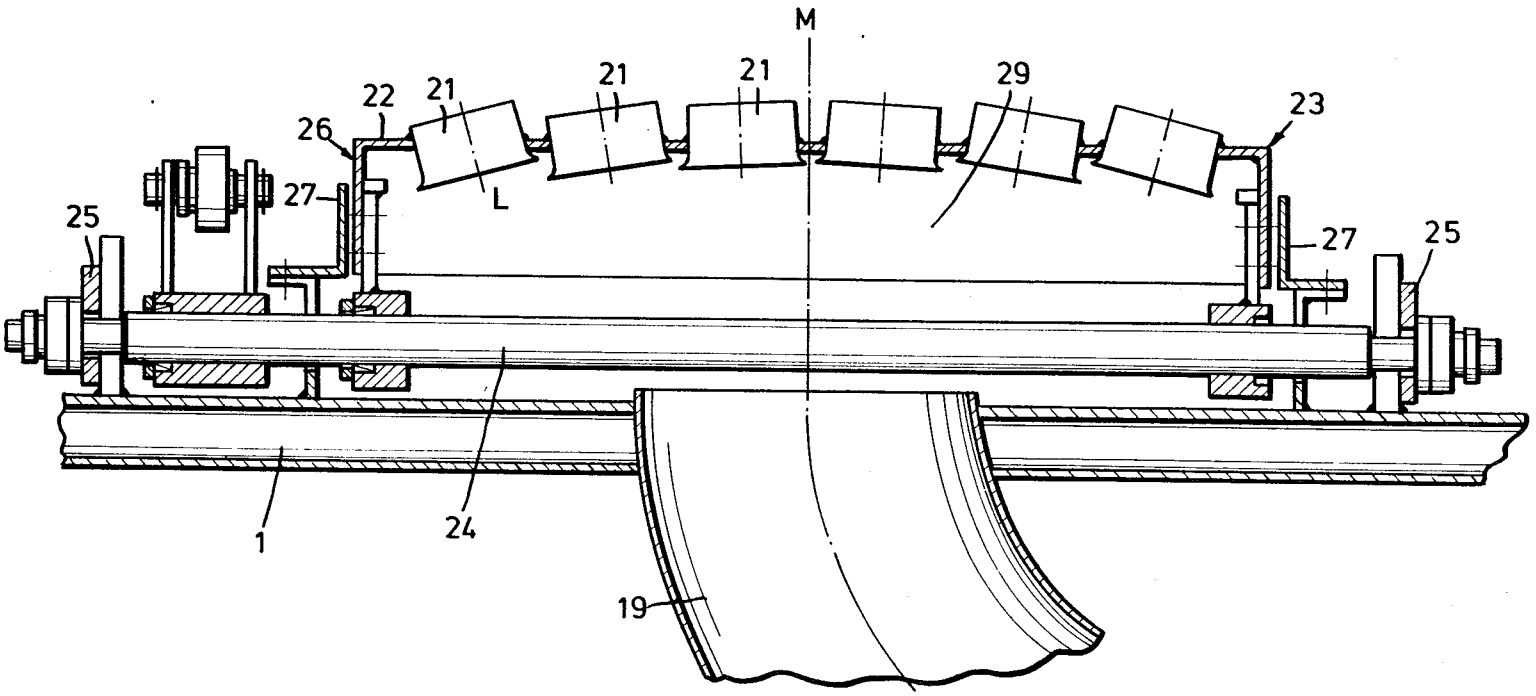
FIG. 3 is an enlarged view of the lower jet nozzle system of the furnace of FIG. 1.
Figure 4:
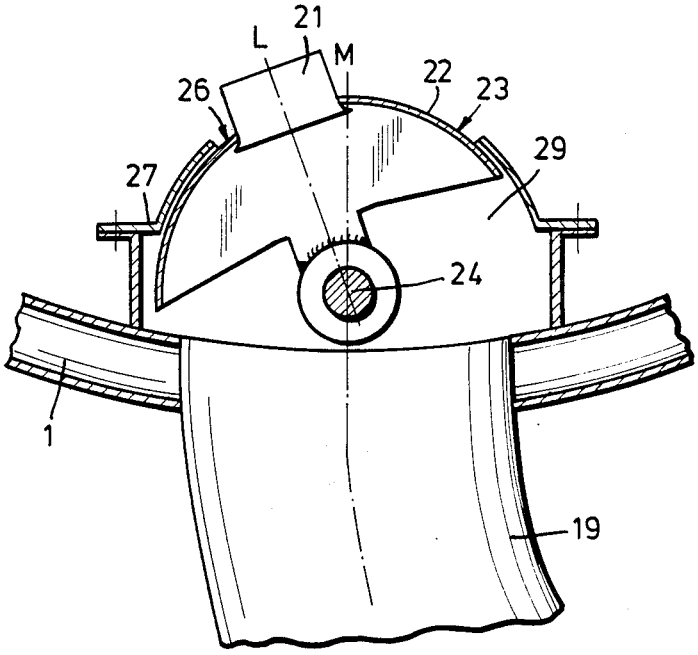
FIG. 4 is an enlarged view of the lower jet nozzle system of the furnace as illustrated in FIG. 2.

Jet nozzles 21, 21' as distribution means for the cooling gas are disposed in the region where the pipes 19, 19' for delivering cooling gas open into the top and bottom of the furnace housing 1. These jet nozzles can be seen particularly clearly in FIGS. 3 and 4. The jet nozzles 21, 21' are cylindrical, and have the same diameter. The jet nozzles 21, 21' are disposed in a row in the shell 22, 22' of a partial cylinder 23, 23'. The axis of the partial cylinder 23, 23' is a pivot shaft 24, 24' about which the partial cylinders, together with the jet nozzles 21, 21', can pivot. Each pivot shaft 24, 24' is journalled in bearings 25, 25' and, by means of a non-illustrated motor, can be pivoted back and forth. Each pivot shaft 24, 24' extends parallel and coaxial to the cross-sectional plane of the chamber opening 9, 9', with the jet nozzles 21, 21' being disposed symmetrical to the median perpendicular M of the cross-sectional plane.

The outer shell surface 26, 26' of the partial cylinder 23, 23' rests against a sealing member 27, 27' which is disposed parallel to the latter and is also cylindrical, so that at every pivot position of the partial cylinder 23, 23', a tight seal is provided between the outer shell surface 26, 26' and the inside of the sealing member 27, 27'. In the extreme positions, the jet nozzles 21, 21' abut the sealing member 27, 27'. The mouth of the pipes 19, 19' for delivering cooling gas is surrounded in a tightly sealing manner by the sealing member 27, 27' in the top and bottom of the furnace housing 1.

The longitudinal central axes L of the jet nozzles 21, 21' meet upstream at a point P on the median perpendicular M of the cross-sectional plane of the chamber opening 9, 9', so that the jet nozzles are disposed at angles. Furthermore, the jet nozzles provided with throttle devices 28, 28' for regulating the distribution of the gas flow to the individual jet nozzles. These throttle devices 28, 28' and the angular disposition of the jet nozzles 21, 21', produce a uniform discharge velocity of the gas jet nozzles, and a uniform impact velocity upon the charge 12. This assures a uniform cooling of the charge 12 transverse to the direction of pivot.

The diameter of the jet nozzles 21, 21' is approximately one tenth of the distance between the jet nozzles and the point of impact upon the charge 12, so that the stream strikes the charge 12 nearly at the velocity with which it is discharged from the jet nozzles 21, 21'.

The described inventive embodiment of a single chamber vacuum furnace which has a pressurized gas quenching device operates as follows. The furnace is filled with a charge 12 through the opened front door 4 and the similarly swung-away door 11. The charge rests within a charge basket on the support 13. The heating chamber door 11 and the front door 4 are then closed, for example to carry out a hardening or tempering. The blocking cover plates 10, 10' of the heating chamber 2 are also closed. The vacuum pump system is now engaged, and the heating chamber 2 is evacuated. By actuating the heating elements 14, temperatures of greater than 1300° C. are obtained in the heating chamber 2. Depending upon the requirements, various temperatures can be produced.

After maintaining the desired operating temperature for a predetermined period of time, the heating chamber 2 is flooded with neutral gas to a pressure of at most 5 bar for quenching or hardening purposes. At the same time, the blower 16 is engaged and the blocking cover plates 10, 10' are opened. The cooling gas is circulated by the blower 16 at a high flow velocity, and the charge 12 is cooled by heat dissipation. Regulation can be effected by means of the flow volume regulator 18 and the throttle valves 20, 20'.

The cooling gas flows from the gas intake 17 of the blower 16, via the pipes 19, 19', into the chamber 29, 29' defined by the partial cylinder 23, 23' and the sealing member 27, 27'. From the chamber 29, 29', the cooling gas is guided onto the charge 12 by the jet nozzles 21, 21'. The cooling gas flows through the charge 12 and again leaves the heating chamber 2 via the opening 9, 9'. An additional opening can also be provided in the heating chamber 2 for this purpose. The cooling of the cooling gas is effected within the heat exchanger 15, from the center of which the cooling gas exits in order to again be drawn through the intake 17 of the blower 16.

During the quenching or cooling process of the charge 12, the jet nozzles are pivoted in order to uniformly guide the cooling gas over the entire charge 12. For this purpose, the partial cylinder 23, 23' executes a continuous back and forth movement about the pivot shaft 24, 24'. The treatment process is effected completely automatically, and produces a very rapid and exceptionally uniform cooling. The rate at which the jet nozzles 21, 21' pivot can be reduced in the extreme positions such that with one pivot movement, cooling gas can blow uniformly against all sections of the charge 12.

FIGS. 5*a* to 5*g* show schematic arrangements of jet nozzles systems for various furnace constructions. FIGS. 5*a*–5*d* show horizontal funaces. In FIG. 5*a*, the jet nozzles are disposed at the top and bottom, such as would be the case for the embodiment illustrated in FIGS. 1 to 4. In FIG. 5*b*, the jet nozzles are disposed at the right and the left sides, and in FIG. 5*c* the jet nozzles are disposed not only at the top and at the bottom, but also to the right and to the left. For longer furnaces (FIG. 5*d*), any number of jet nozzles systems can be disposed one after the other. FIGS. 5*e*–5*g* show vertical furnaces. In FIG. 5*e*, the jet nozzles are disposed to the right and to the left, and in FIG. 5*f* the jet nozzles are disposed all around the furnace. In FIG. 5*g*, the jet nozzles are disposed at several levels.

The present invention, of course, in no way restricted to the specific disclosure of the specification and drawings, but also encompasses any modifications within the scope of the appended claims.

What we claim is:

1. In an industrial furnace, especially a single chamber vacuum furnace, for the thermal treatment of nonuniformly shaped charges and metal workpieces; wherein the furnace includes a heating chamber, which is disposed in a furnace housing, and is adapted to receive a charge; wherein the heating chamber can be heated by heating elements, and is provided with at least one closable chamber opening through which cooling gas can be delivered to said charge; wherein the cooling gas is delivered to said chamber openings via respective delivery pipes, and is circulated via a blower through said delivery pipes, said heating chamber, and a heat exchanger; wherein a distribution means, which is moved back and forth during a cooling process, is pivotably mounted in the vicinity of each of said chamber openings so that supply of cooling gas from above and below the charge can be regulated and, as a result, non-uniformly shaped charges can be uniformly cooled since a greater quantity of heat can be dissipated from a given side thereof;

comprising the improvement in combination therewith wherein said distribution means is in the form of jet nozzles pivotally mounted and provided at each of said chamber openings to control and regulate jet flow of said cooling gas adaptable to flow resistance of said charge, as said cooling gas comes from said delivery pipes, in a location directly before said chamber openings so that said cooling gas flows through said jet nozzles prior to striking said charge to enhance useful life expectancy of said jet nozzles and without need for thermal protection of said jet nozzles so that heat can be dissipated outwardly continuously by said jet nozzles due to lack of thermal protection and also to save energy in that said jet nozzles are kept from having to be heated-up and cooled-off unnecessarily for overall increase in heat-technical effeciency of the furnace, flow direction of said cooling gas being reversible via control and regulation thereof to adjust to optimum cooling conditions.

2. A furnace in combination according to claim 1, in which said jet nozzles are mounted directly ahead of the associated chamber openings.

3. A furnace in combination according to claim 1, in which said jet nozzles are cylindrical.

4. A furnace in combination according to claim 3, in which all of said jet nozzles have the same diameter.

5. A furnace in combination according to claim 1, in which said jet nozzles are pivotably mounted in such a way that they have pivot axis which is parallel to and in a central cross-sectional plane of the associated chamber opening; with respect to each of said chamber openings, said jet nozzles being disposed parallel to said pivot axis in at least one row, and symmetrical to the median perpendicular of said central cross-sectional plane of that chamber opening.

6. A furnace in combination according to claim 5, in which, with respect to each of said chamber openings, the longitudinal central axes of said jet nozzles meet in a point upstream and on said median perpendicular of said central cross-sectional plane of that chamber opening.

7. A furnace in combination according to claim 1, in which each of said jet nozzles is provided with a throttle device.

8. A furnace in combination according to claim 1, in which each of said cooling gas delivery pipes opens into said furnace housing; in which each of said jet nozzles is disposed in the shell of a partial cylinder which has a pivot shaft which coincides with a pivot axis of said jet nozzles; and which includes for each partial cylinder a sealing member which sealingly surrounds the associated cooling gas delivery pipe where the latter opens into said furnace housing; each of said sealing members is disposed parallel to its associated partial cylinder, the shell of which, during pivoting, rests in a sealing manner against said sealing member.

9. A furnace in combination to claim 1, in which said jets have a reduced rate of pivot in the vicinity of their extreme positions.

10. A furnace in combination according to claim 1, in which the diameter of a given one of said jets is at least one tenth of the distance from said jet to the point at which cooling gas coming from that jet strikes said charge.

11. A furnace in combination according to claim 1, in which at least two opposite sides of said heating chamber are provided with substantially identical chamber openings and jets for delivering cooling gas to a charge in said heating chamber.

12. A furnace in combination according to claim 11, in which each of said cooling gas delivery pipes for said jets is provided with throttle valve means which can regulate flow independently of one another.

13. A furnace in combination according to claim 1, which includes a flow volume regulator which is disposed upstream, i.e. ahead, of said blower for regulating the velocity of said cooling gas which is delivered to said jets.

* * * * *